US012180620B2

(12) United States Patent
Mathota et al.

(10) Patent No.: US 12,180,620 B2
(45) Date of Patent: Dec. 31, 2024

(54) THIN HIGH CUT SEAMLESS GLOVE

(71) Applicant: Ansell Limited, Richmond (AU)

(72) Inventors: Mathotarallage Amani Rasika Mathota, Kelaniya (LK); Koshali Gayathri Fernando, Moratuwa (LK); Andarage Naveen Pradeep Kumara, Embilipitiya (LK); Withanage Priyantha Kumara Withanage, Melsiripura (LK); Rathnaweera Patabendige Santhushta Rathnaweera, Udugampola (LK)

(73) Assignee: Ansell Limited, Victoria (AU)

( * ) Notice: Subject to any disclaimer, the term of this patent is extended or adjusted under 35 U.S.C. 154(b) by 391 days.

(21) Appl. No.: 17/629,450

(22) PCT Filed: Jul. 28, 2020

(86) PCT No.: PCT/AU2020/050769

§ 371 (c)(1),
(2) Date: Jan. 24, 2022

(87) PCT Pub. No.: WO2021/016658

PCT Pub. Date: Feb. 4, 2021

(65) Prior Publication Data

US 2022/0243367 A1 Aug. 4, 2022

Related U.S. Application Data

(60) Provisional application No. 62/880,631, filed on Jul. 30, 2019.

(51) Int. Cl.
*D02G 3/38* (2006.01)
*A41D 19/015* (2006.01)
(Continued)

(52) U.S. Cl.
CPC ..... *D02G 3/38* (2013.01); *D04B 1/28* (2013.01); *D06N 3/0009* (2013.01);
(Continued)

(58) Field of Classification Search
CPC ..... D10B 2331/02; D10B 2501/041; D10B 2101/20; A41D 19/00; A61B 5/00
See application file for complete search history.

(56) References Cited

U.S. PATENT DOCUMENTS

2010/0236294 A1* 9/2010 Dias ..... D02G 3/442 66/174
2012/0324623 A1 12/2012 Cabauy et al.
(Continued)

FOREIGN PATENT DOCUMENTS

CN 108505174 A * 9/2018 ..... A41D 19/01505
CN 109093910 A 12/2018
(Continued)

OTHER PUBLICATIONS

Machine Translation of WO2018230945 (Year: 2018).*
International Search Report, PCT application No. PCT/AU2020/050769, dated Nov. 17, 2020.

*Primary Examiner* — Jennifer A Steele
(74) *Attorney, Agent, or Firm* — Moser Taboada

(57) ABSTRACT

A thin coated supported glove and method of making the glove includes a thin knitted liner, including a plurality of finger components, a thumb component, a backhand component, and a palm component, wherein the thin knitted liner comprises a covered yarn including a tungsten core having a diameter of about 25-35 micrometers, a polyamide wrapping yarn disposed upon the tungsten core, and a high performance polyethylene wrapping yarn disposed upon the polyamide wrapping yarn, wherein the covered yarn is (350) denier or less; a second yarn, wherein the second yarn is an
(Continued)

intermingled yarn of (115) denier or less; and a thin polymeric coating adhered to the thin knitted liner.

20 Claims, 3 Drawing Sheets

(51) Int. Cl.

| | |
|---|---|
| ***A41D 19/04*** | (2006.01) |
| ***D02G 3/44*** | (2006.01) |
| ***D04B 1/28*** | (2006.01) |
| ***D06N 3/00*** | (2006.01) |
| ***D06N 3/04*** | (2006.01) |
| ***D06N 3/14*** | (2006.01) |

(52) U.S. Cl.
CPC ..... *D06N 3/0015* (2013.01); *D06N 3/04* (2013.01); *D06N 3/042* (2013.01); *D06N 3/14* (2013.01); *A41D 19/01505* (2013.01); *A41D 19/04* (2013.01); *A41D 2500/10* (2013.01); *D02G 3/442* (2013.01); *D06N 2209/103* (2013.01); *D06N 2209/105* (2013.01); *D06N 2211/103* (2013.01); *D10B 2101/20* (2013.01); *D10B 2321/0211* (2013.01); *D10B 2331/02* (2013.01); *D10B 2501/041* (2013.01)

(56) References Cited

U.S. PATENT DOCUMENTS

| | | | | |
|---|---|---|---|---|
| 2015/0135403 | A1 | 5/2015 | Mercado et al. | |
| 2017/0350044 | A1 * | 12/2017 | Sugita | D02G 3/12 |
| 2020/0354861 | A1 * | 11/2020 | Xu | A41D 31/24 |

FOREIGN PATENT DOCUMENTS

| | | | | |
|---|---|---|---|---|
| CN | 109943940 | A | 6/2019 | |
| JP | 2018-066072 | A | 4/2018 | |
| WO | WO 2018-145145 | A2 | 8/2018 | |
| WO | WO-2018230945 | A1 * | 12/2018 | A41D 19/01511 |
| WO | WO 2019-104370 | A1 | 6/2019 | |

* cited by examiner

THIN HIGH CUT SEAMLESS GLOVE

BACKGROUND

Field

Embodiments of the present disclosure generally relate to personal protective equipment and, more particularly, to thin coated supported gloves having improved abrasion-resistance, cut-resistance, and fabrication methods thereof.

Description of the Related Art

Gloves are commonly used in many industries, such as construction, industrial, and medical, as well as households, to protect the hands of users from abrasions, impacts, and physical injuries. A supported glove is a glove having a fabric liner that is at least partially coated with a coating, such as a polymeric coating. Supported gloves combine durability with relative comfort.

Many of such gloves include polymeric materials as coatings, such as synthetic or natural latex or other elastomers, such as nitrile butadiene rubber and polychloroprene. Some gloves have a foamed polymeric coating to impart flexibility and other comfort-related properties. However, there is a continuous need for thin flexible gloves having increased cut resistant either alone or in combination with abrasion resistance, especially when including a foamed coating, to minimize breaches during use and particularly during extended use while maintaining flexibility and comfort.

Some gloves manufactured include fabric liners including metallic fibers or metallic yarns. However, the inclusion of metal fibers or yarns in a fabric liner problematically reduces the flexibility of the glove and adhesion resistance of coating material applied to the fabric liner. Poor adhesion of a coating to a fabric liner reduces the overall durability of the glove lowering cut and abrasion resistance. In order to achieve robust adhesion, the properties of the polymeric coating must be balanced versus the properties of the knitted liner. Because of the smaller diameter of the thinner yarn and smaller needles used therewith, the interstices of a knitted article may become excessively dense thus limiting the penetration of the polymeric coating, resulting in poor adhesion. Conversely, if the interstices are too open, as is also possible when knitting small diameter yarns with larger needles, the polymeric coating would fully penetrate the article, limit flexibility, and lead to user-discomforting strike through.

Therefore, there is a continuous need for gloves formed with thin coated fabric liners, the gloves having abrasion and cut resistance and methods of producing such durable gloves.

SUMMARY

Abrasion and cut resistant coatings and coated gloves, and methods for manufacturing abrasion and cut resistant, foamed or unfoamed, coatings and coated gloves, substantially as shown in and/or described in connection with at least one of the figures herein, are disclosed as set forth more completely in the claims. Various advantages and features of the present invention will be more fully understood from the following description and drawings.

Methods and apparatus for thin coated supported gloves are provided herein. In some embodiments, a thin coated supported glove, includes: a thin knitted liner, including a plurality of finger components, a thumb component, a backhand component, and a palm component, wherein the thin knitted liner includes a covered yarn including a tungsten core having a diameter of about 25-35 micrometers (such as about 28 to about 32 micrometers), a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn is an intermingled yarn of 115 denier or less; and a thin polymeric coating adhered to the thin knitted liner.

In embodiments, the knitting is single knitting. In embodiments, the smooth side of the knit is oriented toward the user's hand (inside). In embodiments, the single knitting is jersey, French terry, sweatshirt fleece, plated or the like. Generally, the various recitations as to the properties of the gloves do not pertain to the cuff region. For example, the knitting style of the can differ. For example, where the bulk of the glove is single knit, the cuff may for example be double knit, or knit in a different style.

In some embodiments, a method for manufacturing a thin coated supported glove is provided, which method includes: dressing a 21 to 28-gauge knitted liner (generally 21 to 23 gauge, such as 21 gauge (i.e., 21 needles per inch)) on a hand-shaped former; applying an aqueous coagulant solution to the 21-gauge knitted liner; dipping the 21-gauge knitted liner into a polymeric emulsion, wherein the polymeric emulsion is about 60 to about 100 parts per hundred (PHR) nitrile-butadiene (NBR) polymer formulation forming a polymeric coating on the knitted liner; and curing the polymeric coating to form a thin coated support glove, wherein the 21-gauge knitted liner includes a plurality of finger components, a thumb component, a backhand component, and a palm component, wherein the 21-gauge knitted liner comprises a covered yarn including a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less. In embodiments, the aqueous coagulant solution includes a 40% wt or less of weak acid.

In embodiments, the polymeric emulsion is about 70 to about 100 parts, or about 80 to about 100 parts, or about 90 to about 100 parts, or about 100 parts NBR. Secondary polymers can for example be natural rubber, synthetic polyisoprene, styrene-butadiene, carboxylated or non-carboxylated 10 acrylonitrile-butadiene, polychloroprene, polyacrylic, butyl rubber, or water-based polyurethane (polyester based or polyether based), or combinations thereof.

In some embodiments, a thin coated supported glove, includes: a 21-gauge knitted liner, including a plurality of finger components, a thumb component, a backhand component, and a palm component, wherein the 21-gauge knitted liner includes a covered yarn including a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn of 115 denier or less including a nylon and a spandex; and a thin polymeric coating adhered to the 21-gauge knitted liner.

The foregoing summary is not intended, and should not be contemplated, to describe each embodiment or every implementation of the present disclosure. Other and further embodiments within the scope of the present disclosure are described below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only illustrative embodiments of this invention and are therefore not to be considered limiting of its scope, for the invention may admit to other equally effective embodiments. It is to be understood that elements and features of one embodiment may be in other embodiments without further recitation. It is further understood that, where possible, identical reference numerals have been used to indicate comparable elements that are common to the figures.

DETAILED DESCRIPTION

Embodiments of the present disclosure include gloves, coatings, and methods for making durable gloves and coatings having improved physical properties, and especially abrasion- and cut-resistance properties, while maintaining a very thin and flexible glove for improved dexterity during use. Gloves disclosed herein have vastly improved cut resistance, as well as increased abrasion resistance. For example, latex, polymeric, or elastomeric coatings, as well as coated gloves, made in accordance with embodiments of the disclosure, are capable of attaining ANSI Standard A5, A6, or A7 cut resistance and may include a 21 gauge tungsten seamless liner dipped in a foamed or unfoamed thin polymer (e.g., water based) coating giving an thin, durable, supported glove. In some embodiments, the glove may be breathable. Also, gloves in accordance with embodiments of the invention have attained at least an ANSI Standard A5 cut resistance while achieving an abrasion resistance of EN level 4.

A "thin" polymer coating is measured relative to the thickness added to a thin liner. A "thin" liner is one that is about 0.4 mm to about 0.8 mm in thickness, such as about 0.5 mm to about 0.8 mm. A "thin" polymer coating is one such that the combined thickness with the thin liner is about 0.7 mm to about 1.2 mm, such as about 0.8 mm to about 1.2 mm. References herein to "glove" thickness are references to the thickness of the glove in coated regions.

Figure 1:
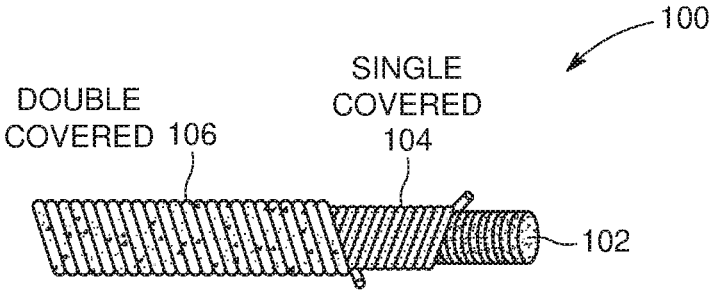
FIG. 1 shows a diagram of a first covered yarn according to embodiments of the disclosure.

FIG. 1 shows a diagram of a first covered yarn 100 suitable for use in accordance with embodiments of the present disclosure. In some embodiments, the first covered yarn 100 includes a tungsten core 102. In some embodiments, the tungsten core 102 is a wire or filament of pure tungsten or substantially pure tungsten. In embodiments, the tungsten core 102 may be doped or adulterated with additional materials such as metal or carbon. In some embodiments, the tungsten core 102 has a diameter of about 25-35 micrometers, or 27 to 33 micrometers. In some embodiments, the tungsten core 102 has a diameter of about 30 micrometers such as 29 micrometers, 30 micrometers, or 31 micrometers throughout the total length of the tungsten core. In some embodiments, tungsten core 102 is characterized as a metalized filament made from thinly drawn tungsten having a flexibility sufficient enough to be woven. In some embodiments, the tungsten core 102 has a length sufficient to form the total length of a yarn such as a yarn suitable for forming a fabric liner in accordance with the present disclosure. In some embodiments, the tungsten core 102 has a length of 100 to 1000 meters. In some embodiments, the tungsten core 102 has a length sufficient to form a thin knitted liner such as knitted liner 300 in accordance with FIG. 3.

In some embodiments, as shown in FIG. 1, at least one first wrapping yarn 104, such as a polyamide wrapping yarn, is disposed upon the tungsten core 102, which covers the tungsten core 102. In embodiments, the at least one first wrapping yarn 104 is a 40-70 denier yarn, such as a 20-50 denier yarn. In some embodiments, the at least one first wrapping yarn 104 is a nylon yarn. Non-limiting examples of suitable nylon yarn for use herein includes a nylon 6 or a nylon 6,6 yarn and may be, for example, a 40-70 denier yarn such as a 20-50 denier yarn. In some embodiments, the present disclosure includes a single covered yarn, for example, where the tungsten core 102 is covered with one first wrapping yarn such as first wrapping yarn 104 having a polyamide or nylon composition. In some embodiments, the at least one first wrapping yarn 104 has a length sufficient to wrap around and cover the length of tungsten core 102. In some embodiments, the at least one first wrapping yarn 104 is a polyamide wrapping yarn which is textured.

In some embodiments, as shown in FIG. 1, the present disclosure includes a doubled covered yarn, for example, where the tungsten core 102 is covered with one first wrapping yarn such as first wrapping yarn 104 having a polyamide or nylon composition, wherein a second wrapping yarn 106 is disposed upon first wrapping yarn 104. In some embodiments, the second wrapping yarn 106 is wound in a direction opposite to the direction of winding of the first wrapping yarn 104. In at least one embodiment according to the disclosure, a second wrapping yarn 106 is a high-performance polyethylene (HPPE) yarn wrapped, such as in an S or Z wrapping configuration, around the at least one first wrapping yarn 104. In some embodiments according to the disclosure, the covered yarn 100 comprises a second wrapping yarn 106 which completely covers the first wrapping yarn 104. In some embodiments, the second wrapping yarn 106 is, for example, a 20-100 denier yarn, 20-50 denier yarn, or 50 to 100 denier yarn.

In embodiments, the total denier of a first covered yarn 100 having tungsten core 102, at least one first wrapping yarn 104, and a second wrapping yarn 106 is approximately 350 denier or less, or between about 320 and about 350 denier, or between about 330 and about 350 denier, or about 350 denier, or 350 denier. In embodiments, the total denier of the first covered yarn 100 is suitable for use with 21-gauge needles on a knitting machine.

Embodiments according to the disclosure further include yarns wherein the first covered yarn 100 may further include polyester yarns, filaments, staple fibers, and the like, additional high-performance polyethylene (HPPE) or ultra-high molecular weight polyethylene (UHMWPE) yarns, filaments, staple fibers, and the like, glass fibers, steel yarns, and other fibers and filaments known to those in the art.

In some embodiments, the first covered yarn 100 includes tungsten in an amount of about 30% to about 50% weight of the total covered yarn, or about 35 to about 45 percent weight of the total covered yarn, polyamide in an amount of about 40 to about 50 percent weight of the total covered yarn, and high performance polyethylene in an amount of about 10 to about 20 percent weight of the total covered yarn. In some embodiments, the first covered yarn 100 includes tungsten in an amount of about 38 to about 42 percent weight of the total covered yarn, polyamide in an amount of about 42 to about 46 percent weight of the total covered yarn, and high-performance polyethylene in an amount of about 14 to about 18 percent weight of the total covered yarn. In some embodiments, the first covered yarn 100 includes tungsten in an amount of about 40 percent weight of the total covered yarn, polyamide in an amount of about 44 percent weight of the total covered yarn, and high-performance polyethylene in an amount of about 16 percent weight of the total covered yarn.

In some embodiments, the first covered yarn 100 includes a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less, or between about 320 and about 350 denier.

In some embodiments, the first covered yarn 100 includes a tungsten core having a diameter of about 30 micrometers such as 29 micrometers, 30 micrometers, or 31 micrometers throughout the total length of the tungsten core, a polyamide wrapping yarn disposed upon the tungsten core, and a high performance polyethylene wrapping yarn disposed upon the polyamide wrapping yarn, wherein the covered yarn 100 is about 350 denier or less, such as, for example, about 320 to about 350 denier.

Figure 2:
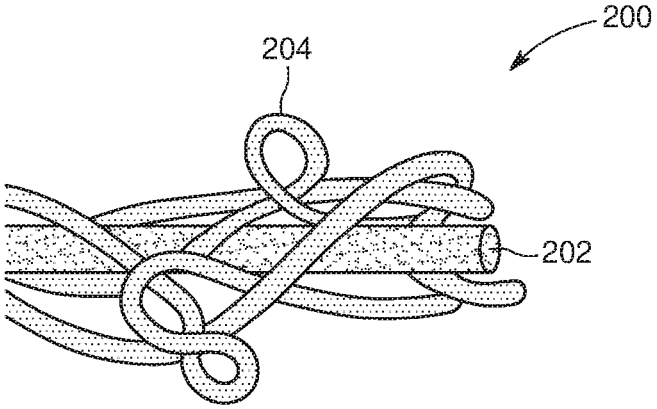
FIG. 2 shows a diagram of a second yarn according to embodiments of the disclosure.

FIG. 2 shows a diagram of a second covered yarn 200, according to embodiments of the disclosure. In embodiments, the second covered yarn 200 includes a core yarn 202 and an intermingled yarn 204, which covers the core yarn 202. In at least one embodiment according to the disclosure, the core yarn 202 is an elastomeric yarn, such as an elastane yarn and/or polyester yarn, e.g., LYCRA® or spandex The core yarn 202 may be, for example, a 20-80, 40-70, such as 70 denier yarn. Also, in at least one embodiment according to the disclosure, the intermingled yarn 204 is a nylon or polyamide yarn, such as a nylon 6 or a nylon 6,6 yarn (also expressed as nylon 66). In at least one embodiment according to the disclosure, the intermingled yarn 204 is an about 30 to about 50 denier yarn, such as 40 denier yarn. In some embodiments, the total denier of the second covered yarn 200 in some embodiments may be approximately 115 denier. In embodiments, the second covered yarn 200 comprises an intermingled yarn 204 comprising or consisting of a polyamide yarn of about 40 denier or less (such as e.g. about 30 to about 45 or 50 denier) and a core yarn 202 comprising or consisting of polyether-polyurea copolymer yarn of about 70 denier or less (such as e.g. about 60 to about 70 denier). In some embodiments, the second yarn is about 115 denier or less, or between about 105 denier to about 115 denier. In embodiments, the second yarn has a total denier suitable for use in a 21 gauge needle.

Embodiments according to the disclosure further comprise yarns wherein the second covered yarn may further include polyester yarns, filaments, staple fibers, and the like. Embodiments according to the disclosure further comprise yarns such as high-performance polyethylene (HPPE) or ultra-high molecular weight polyethylene (UHMWPE) yarns, filaments, staple fibers, and the like. Embodiments according to the disclosure further comprise para-aramid and/or meta-aramid yarns, fibers, and/or filaments. Any of the yarns contemplated herein may comprise glass fibers, steel yarns, ceramic fibers, and other fibers and filaments known to those in the art.

In some embodiments, the first covered yarn 100 and/or the second covered yarn 200 have a thickness suitable for being knitted using 21-gauge needles. In embodiments, the first covered yarn and second covered yarn, alone, or in combination have a thickness suitable for being inserted into and used in a knitting machine.

Figure 3:
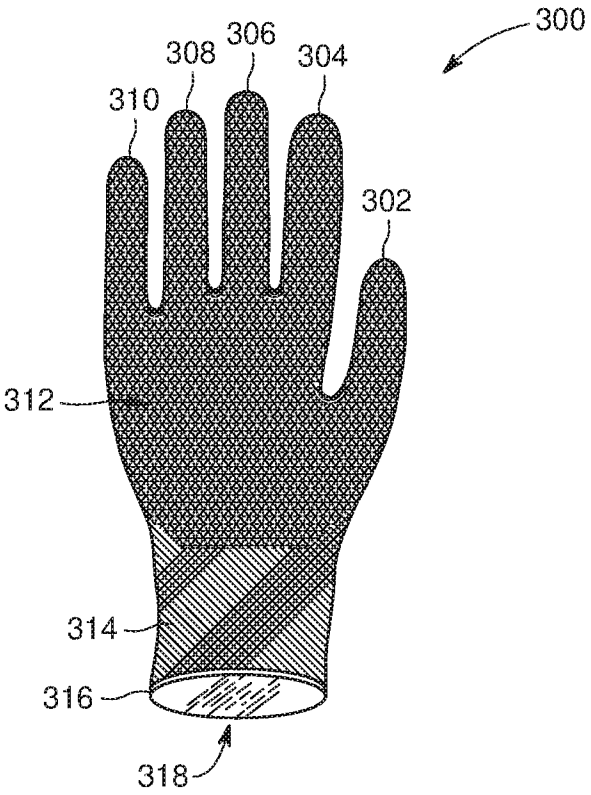
FIG. 3 shows a diagram of a thin knitted liner according to embodiments of the disclosure.

FIG. 3 shows a diagram of a thin knitted liner 300 according to embodiments of the disclosure. In embodiments, the thin knitted liner 300 includes a thumb 302, an index finger 304, a middle finger 306, a ring finger 308, a little finger 310, a knuckle area 312, and, optionally, a cuff area 314 and/or a bead 316. The thin knitted liner 300 further includes an opening 318 for a wearer to don the thin knitted liner 300 or for the thin knitted liner to be placed upon a former for subsequent coating as described herein. It is to be understood that the thin knitted liner 300 may also include a palm area that is not shown in this view. In embodiments, the thin knitted liner 300 is knitted using a knitting machine. The thin knitted liner 300 is knitted using, for example, the first covered yarn 100 or the second covered yarn(s) 200 as described above in amounts sufficient to form the thin knitted liner 300. In some embodiments, the first covered yarn 100 and second covered yarn 200 may be combined in a plating technique to form a fabric such as the knitted liner 300 in accordance with the present disclosure. For example, first covered yarn 100 and second covered yarn 200 may be simultaneously fed to the knitting machine, such that the first covered yarn 100 is placed under the second covered yarn 200, and/or so that each yarn can be rolled to a specific side of a fabric. In embodiments, the first covered yarn 100 forms a layer of material adjacent or below a layer of the second covered yarn 200. In embodiments, coating may be applied atop a layer of the second covered yarn 200, or atop a layer of a first covered yarn 100 in a fabric such as the knitted liner 300. Embodiments according to the disclosure further include a coating to form a supported glove, as described further below.

Figure 4:
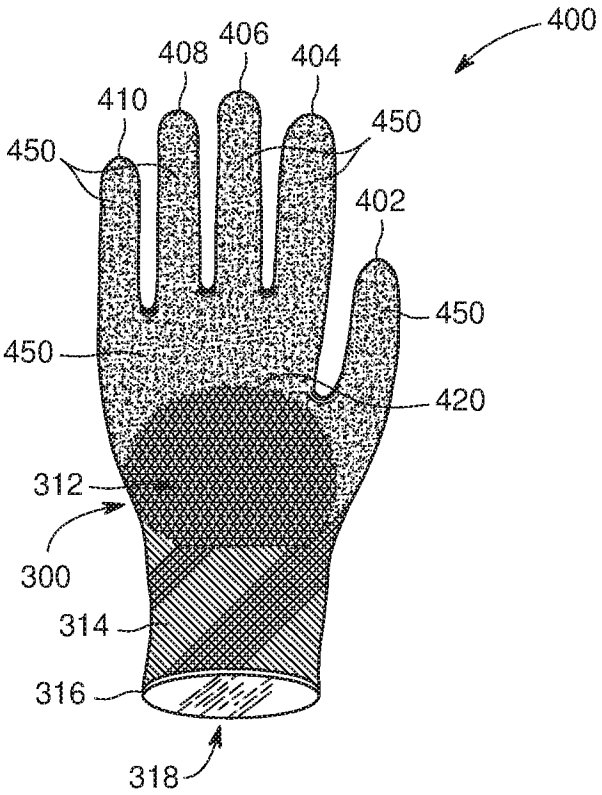
FIG. 4 shows a diagram of a thin knitted liner having a thin coating disposed on the thin knitted liner, forming a lightweight thin supported glove according to embodiments of the disclosure.

FIG. 4 shows a diagram of the thin knitted liner 300 having a thin coating 450 disposed on the thin knitted liner 300, forming a thin supported glove 400; according to embodiments of the disclosure. In embodiments, the thin supported glove 400 includes a coated thumb 402, a coated index finger 404, a coated middle finger 406, a coated ring finger 408, a coated little finger 410, a coated knuckle area, an uncoated cuff area 314, and/or optionally the bead 316. Alternatively, or additionally, the thin coating 450 is indicated by the darker shaded areas, noting that a texture of the thin knitted liner 300 can still be viewed under the thin coating 450. A cross-sectional thickness of the coated regions of the thin lightweight supported glove 400 generally ranges from 0.80 mm to 1.20 mm or approximately thereof including 0.9 mm. Table 2 below shows additional cross-sectional thicknesses of gloves of the present disclosure. The thin supported glove 400 further comprises the opening 318 for a wearer to don the thin supported glove 400.

It is to be understood that the thin knitted liner 300 also comprises a coated palm area that is not shown in this view. Embodiments according to the disclosure further include a coating to form a supported glove wherein a three-quarter-dipped supported glove, which covers an upper backhand area 420 with the thin coating 450. It is to be further understood that other styles of dipping, as are known to those in the art, are within the scope of embodiments of the disclosure of the thin coated supported glove. For example, embodiments optionally include a knuckle-dipped supported glove (in which an upper backhand area 420 would not be coated), a full-dip supported glove, a palm-dip supported glove, and/or the like.

The inventors have unexpectedly overcome problems associated with previous methods for coating thin liners including metallic materials with thin coatings. Therefore, optionally, 21-gauge needle-knitted liners including one or more covered yarns as described herein including a covered yarn with a tungsten core, which are thin, can be coated with aqueous polymeric emulsions, for example, aqueous polyurethanes, and/or blends or aqueous polyurethanes with other aqueous emulsions. For example, a blend of a nitrile-butadiene (NBR) emulsion with an aqueous polyurethane emulsion. Also, 21-gauge needle-knitted liners can be coated with aqueous NBR or NBR blends. The inventors have unexpectedly produced thin knitted liners 300, wherein the thin coating 450 and even more especially so in regards with disposing a thin aqueous polymeric coating, is disposed onto the thin knitted liner 300, producing a thin coated supported glove that is thin, flexible, durable and, optionally, breathable.

The thin supported glove 400, according to embodiments of the disclosure, comprises the thin coating 450, wherein an EN388 (2016) level 4 Abrasion (>8000 cycles) is achieved despite being thin. Alternatively, in some embodiments, the thin coating 450 is unfoamed but maintains breathability and abrasion resistance. Without intending to be bound by theory, it is thought that the thin knitted liner 300 and the thin coating 450, because each is integrally formed within each other in creating the thin coated supported glove 400 and because the yarn(s) are penetrated by the thin coating 450 without a discomforting amount of strikethrough. This integration e.g., allows "channels" to form, providing breathability. Moreover, excellent adhesion of the yarn(s) and the thin coating provides high abrasion despite the thinness of the thin coated supported glove and inclusion of metal therein. In this context, integrally formed means that the yarns of the thin knitted liner 300 are penetrated by the thin coating 450 to an extent where disassembly is not possible without destroying one or more of the thin knitted liner 300 or the thin coating 450.

At least one thin coating 450, according to embodiments of the disclosure, is formulated using the formula, which is dimethyl formamide (DMF)-free, as described in Table 1. The polymeric emulsion can have a low viscosity, by way of example and not limitation, a viscosity in the range of 300-2000 centipoises. In some embodiments, the polymeric emulsion uses a very low viscosity polymer formulation nonetheless with high total solid contents such as 35 to 45 percent. In some embodiments, the polymeric emulsion may comprise commonly used stabilizers including but not limited to potassium hydroxide, ammonia, aluminum sulfates, sulfonates and others known to those in the art. The polymeric emulsion may comprise other commonly used components, such as surfactants, anti-microbial agents, fillers/additives, and/or the like. The amounts of the components within Table 1 are expressed in parts-per-hundred weight dry rubber (PHR) as is known to those in the art. (All amounts and ranges can be about that amount and from about to about.) Not all ingredients shown in Table 1 must be included, for examples waxes, pigments, and thickening agents may not be present in some embodiments.

TABLE 1

| | TSC range (% by weight) | Component | Parts per hundred rubber (PHR) |
|---|---|---|---|
| | 35-45 such as 45 | NBR or NBR blend | 100 |
| | 20-30 such as 25 | Ammonia | 0.1-0.3 such as 0.2 |
| | 40-60 such as 50 | Zinc oxide | 2.5-4.5 such as 3.00 |
| | 30-40 such as 35 | Wax | 0.2-2.5 such as 0.8 |
| | 100 | Pigments | 1.0-3.0 such as 1.2 |
| | 4-8 such as 6 | Thickening agent(s) | 0.01-0.2 such as 0.1 |
| Total | 40-46 such as 44 | | |

The polymeric emulsions such as those shown in Table 1 above includes an unexpectedly low viscosity while having a very high total solids content (TSC), allowing a thin coating to penetrate the fibers of which the yarns are comprised while nonetheless inhibiting strikethrough, i.e., wherein the polymeric emulsion penetrates far enough into the thickness of the liner to contact the skin when the glove is worn. At least one exemplary embodiment according to the disclosure includes a formulation unexpectedly having a TSC of 35 to 45% and a viscosity of 300-2000 centipoises. Also, at least one embodiment according to the disclosure comprises a thin coating 450 that is treated with a weak acid coagulant, such as acetic acid, formic acid, tricarboxylic acids, and other weak acids or any blends of these weak acids, so that the internal molecules of the coating form additional cross-links. The thin coating 450 may then be treated with a strong coagulant to more fully gel and cross-link the outer molecules, producing a thin coating 450 that is through-hardened, i.e., gelled or cross-linked throughout a thickness of a polymeric layer, as opposed to case-hardening (a coating in which only the outer surfaces of the coating are fully cross-linked). The technology for producing a thin coating 450 that is through-hardened is disclosed in commonly-assigned U.S. Publ. No. 2014-0000006 entitled Abrasion and Cut Resistant Coating and Coated Glove herein incorporated by reference in its entirety.

Referring to Table 1, in some embodiments, ammonia may be present in an amount of about 0.1 to about 0.3 PHR, or about 0.2 PHR. In some embodiments, curing agents such as zinc oxide may be present in amount of about 2.5 PHR to about 4.5 PHR such as about 3.00 PHR. In some embodiments, wax and/or lubricating agents may be present in amount of about 0.2 PHR to about 2.5 PHR or about 0.8 PHR. In some embodiments, pigments, may be present in an amount of about 1.0 PHR to about 3.0 PHR such as 1.2 PHR. In some embodiments, thickening agents may be present in an amount of about 0.01 PHR to about 0.2 PHR, or about 0.1 PHR. In embodiments, a polymeric emulsion may comprise a total solids content of 35-45% by weight of the total composition.

Also, at least one embodiment according to the disclosure comprises a thin coating 450 that is treated with a salt treatment. The thin coating 450 may be treated with a salt bath, alternatively before or after a curing step, comprising salt particles, such as sodium chloride salt particles. The salt particles, in addition to becoming embedded in the thin coating 450, wherein multi-faceted textures are imparted, providing enhanced gripping properties, also provides additional strength, i.e., abrasion resistance to the thin coating 450. The technology for treating the thin coating 450 with a salt bath treatment is disclosed in commonly-assigned U.S. Pat. Nos. 7,378,043; 7,771,644; 7,814,570; and 8,522,363, which described technology is incorporated herein by reference in its entirety.

Figure 5:
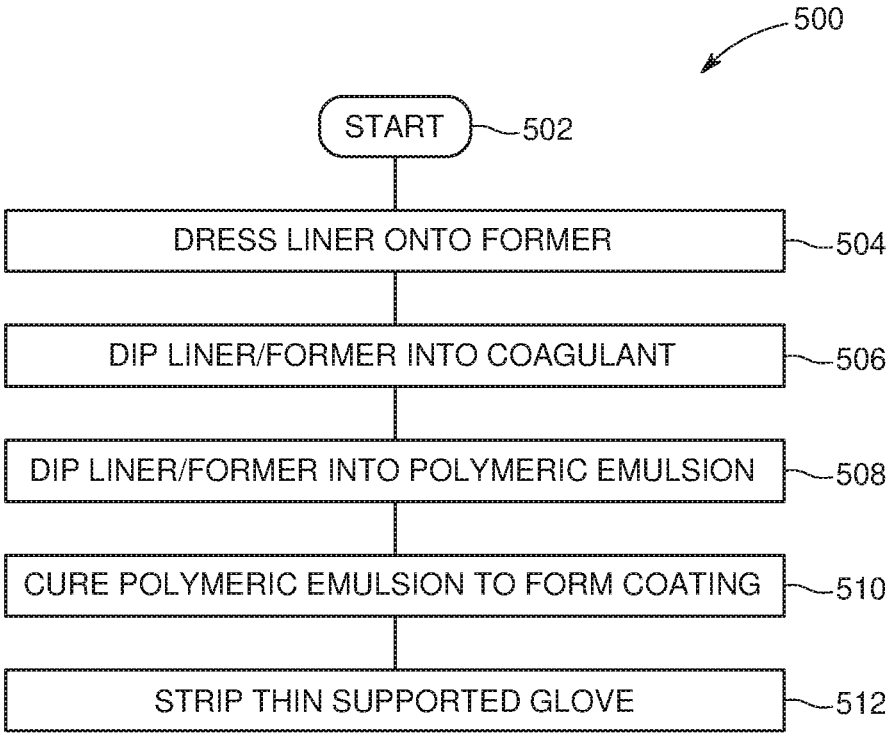
FIG. 5 depicts a method for manufacturing thin coated supported gloves according to embodiments of the disclosure.

FIG. 5 depicts a method 500 for manufacturing thin coated supported gloves; according to embodiments of the disclosure. The method 500 starts at step 502 and proceeds to step 504, wherein a liner, such as a 21-gauge knitted liner, as described herein, is dressed onto a former such as a hand shaped former. At step 506, the former such as a hand shaped former having the 21-gauge knitted liner disposed thereon is dipped into a coagulant such as a coagulant solution and removed. In some embodiments, the coagulant solution comprises 40% or less aqueous concentration of weak acid such as acetic acid. In embodiments, an aqueous concentration of weak acid may further comprise a surfactant(s). In some embodiments, the thin knitted liner having the coagulant solution contacts the polymeric emulsion, wherein it destabilizes the polymeric emulsion and gels the emulsion. Without intending to be bound by theory, it is believed that the weak acid coagulant allows a penetration, through-hardening, and adhesion of the thin coating to the thin knitted liner of the present disclosure. Also, optionally, the coagulant solution that is disposed on the thin knitted liner may be heated to dry the coagulant solution. Also, optionally, the 21-gauge knitted liner of the present disclosure first has a wetting agent disposed thereon before dipping into the coagulant solution. In some embodiments, the liners of the present disclosure may be covered using methods described in International Patent Publication No. WO 2018/145145 to Fernando et al. entitled Thin Coated Supported Glove (herein incorporated by reference in its entirety).

At step 508, the former such as a hand shaped former having the 21-gauge knitted liner dressed thereon is then dipped into a polymeric emulsion, such as the polymeric emulsion created by the formula described in Table 1. The polymeric emulsion in Table 1 generally has a very low viscosity, e.g., 300-2000 centipoises. The polymeric emulsion, as well as penetrating the yarns of the knitted liner, also unexpectedly does not penetrate the entire thickness of the knitted liner via the interstices, resulting in a thin coating that adheres well to the knitted liner without causing strike-through, which can be uncomfortable to a wearer of a supported glove. The hand shaped former may be dipped in a palm dip, three-quarters dip, full dip, etc., as described above and removed, forming a polymeric coating on the 21-gauge, thin knitted liner. At step 510, the former such as a hand shaped former having the thin knitted liner and polymeric coating is then delivered to a curing oven at a temperature of 90-130 degrees Celsius for 30 to 70 minutes.

At step 512 the thin supported glove is stripped from the hand shaped former and the method 500 ends. Other steps may be included in the method 500. For example, a washing step may be performed in hot water before the curing step or after the curing step. Also, a salt treatment and/or a weak acid treatment, as described above, may be used. Generally, the salt treatment will be performed before the curing step. Also, generally, the weak acid treatment may be performed before and/or after the curing step.

In embodiments, at yarn cross-over points, when using a preselected denier yarn, the knitted liner can have a thickness of approximately 0.5 mm to 0.8 mm. Table 2 below shows additional knitted liner thicknesses suitable for use in accordance with the present disclosure. Also, at yarn cross-over points, when using a 350 denier yarn, the knitted liner can have a thickness of approximately 0.6 mm. Wherein a 21-gauge needle knitted liner is coated with polymeric emulsion, forming a coating, the coating thickness can be close to the thickness of the thin knitted liner, and the lightweight thin supported glove can have for example a final thickness in the range of 0.80 mm to 1.2 mm. Table 2 below shows additional thicknesses of gloves in accordance with the present disclosure. The overall weight of the lightweight thin supported glove comprising a 21-gauge knitted liner and a thin polymeric coating can be, likewise, lighter than comparable gloves with EN388 (2016) level 4 Abrasion. Alternatively, or additionally, embodiments of the disclosure include a supported glove in which the coating (e.g., full, ¾, palm or knuckle coating), such as the thin coating 450, is a continuous coating. For example, the thin coating 450 covers the thin knitted liner, such as the thin knitted liner 300, without gaps.

In embodiments, the thickness of the glove may be varied to obtain a predetermined cut resistance level. For example, the thin coated supported glove of the present disclosure may be formed, wherein the glove has a thickness of approximately 0.7 to about 0.9 mm (e.g., about 0.75 to about 0.85 mm, or about 0.8 mm) and a level A5 cut resistance (per ANSI/ISEA 105 (2016 edition)), a thickness of approximately 0.8 to about 1.0 mm (e.g. about 0.85 mm to about 0.95 mm, or about 0.9 mm) and a level A5 cut resistance, or a thickness of approximately 1.0 to about 1.2 mm (e.g., about 1.05 mm to about 1.15 mm, or about 1.1 mm) and a level A7 cut resistance. In embodiments, the thickness of the yarn and/or thickness of the coating may be varied to provide a glove of predetermined thickness. Table 2 below shows additional cut resistance to glove/liner thickness in accordance with the present disclosure. Gloves of the invention can generally have a level A5, A6 or A7 cut resistance.

As stated above, the gauge knitting needle used is generally selected according to the denier of the yarn being used. Although it is possible to use a larger gauge needle to knit smaller denier yarns, i.e., smaller diameter yarns, such a combination results in excessive spacing, i.e., interstices, between the yarn courses in the thin knitted liner, which would be larger than the desired spacing. The interstices spacing is typically in the range of one to three times the diameter of the yarn used to knit the liner, when a proper needle gauge is selected. Furthermore, the difference between the yarn diameter and the interstices changes when the liner is put on a former so that the interstices diameter can be three times larger than the yarn diameter due to stretching of the thin knitted liner.

As stated above, coating knitted liners can be challenging. A 21-gauge knitted liner prepared from a covered two-ply yarn, such as first covered yarn and second covered yarn described herein, can be approximately 0.5 to 0.6 mm thick. The 21-gauge knitted liner is coated with a polymeric emulsion to form a coating, can result in a glove thickness of approximately 0.80 mm to 0.90 mm. A glove having a 21-gauge knitted liner is coated with, for example, a nitrile-butadiene (NBR) emulsion or an NBR blend of emulsions, having integrally formed penetration and can have a thickness nearly equal to that of the knitted liner which is approximately 0.50 to 0.6 mm. In at least one embodiment according to the disclosure, the emulsion penetrates between about 40-75% of the thickness of the knitted liner. In at least one embodiment according to the disclosure, the emulsion penetrates less than about 60% of the thickness of the knitted liner and in some embodiments less than about 50% and in some embodiments less than about 40% of the thin knitted liner.

In one or more embodiments according to the disclosure, the polymeric emulsion is coated over selected portions of the glove generally including the palm and finger (particularly palm side) regions of the glove while the portion of the liner at the back of the hand are not coated with the polymeric emulsion, wherein breathability is promoted even further. Nonetheless, because of the breathability of some thin knitted liner and thin coating embodiments, a full-dip style remains an unexpected advance in the art. Also, in embodiments according to the disclosure, the polymeric emulsion comprises natural rubber, synthetic polyisoprene, styrene-butadiene, carboxylated or non-carboxylated acrylonitrile-butadiene, highly carboxylated acrylonitrile-butadiene (e.g., >35% carboxylation), polychloroprene, polyacrylic, butyl rubber, or water-based polyurethane (polyester based or polyether based), or combinations thereof.

In at least one embodiment according to the disclosure, the polymeric coating, e.g., the thin coating, is foamed using dispersed air cells in the range of 5 to 60% volumetric percentage forming closed cells or open cells with interconnected porosity in the polymeric layer. Closed cells provide a liquid proof polymeric coating that is highly flexible, soft and spongy, and provides good dry and wet grip. Closed cells are normally associated with air content in the 5 to 15% volumetric percent range. Open cells that are interconnected normally occur in the 15 to 50% air volumetric range and provide breathability of the glove through the foamed polymeric layer.

Due to the smaller diameter of the yarns of which the thin knitted liner may be comprised, the distance between the fibers decrease rapidly, forming a pinch region in the knitted liner and when the polymeric emulsion enters this region, the gelling action of coagulant applied to the line essentially chokes the ingress of the polymeric emulsion, wherein the penetration of the polymeric emulsion into the thickness of the thin knitted liner through the interstices is substantially prevented. This penetration and gelling action is a function of the viscosity of the polymeric emulsion and the depth to which the former with the coagulant coated liner is depressed into the polymeric emulsion. The higher the hydrostatic pressure, i.e., deeper penetration, the polymeric emulsion penetrates more into the thin knitted liner. Therefore, among the controllable process variables for controlling the penetration of the polymeric emulsion into the thin knitted liner are 1) the control of polymeric emulsion viscosity and 2) depth of immersion of the knitted liner dressed former. The thin lightweight supported glove described herein is approximately 30% less in weight and thickness compared to an 18-gauge glove, and has better than three times the flexibility.

Flexibility can be measured by the Gurley Stiffness Test on an excised coated section of the glove, using the Gurley Model 4171S. Test samples are taken from the palm area, the samples sized 50.8 mm (2 inches)×25.4 mm (1 inch) so as to give a deflection between 1 and 7 on the scale of the Gurley Bending Resistance/Stiffness Tester. The rectangular test specimens are clamped centrally without stretching in the specimen clamp in such a manner that 6.4 mm (0.25 inch) will be held in the jaws.

In some embodiments, the present disclosure relates to a method for manufacturing a thin coated supported glove, including: dressing a 21-gauge knitted liner on a hand-shaped former; applying an aqueous coagulant solution to the 21-gauge knitted liner; dipping the 21-gauge knitted liner into a polymeric emulsion, wherein the polymeric emulsion is a 100 parts per hundred (PHR) nitrile-butadiene polymer formulation, forming a polymeric coating on the knitted liner; and curing the polymeric coating to form a thin coated support glove, wherein the 21-gauge knitted liner including a plurality of finger components, a thumb component, a backhand component, and a palm component, wherein the 21-gauge knitted liner comprises a covered yarn comprising a tungsten core having a diameter of about 25-35 micrometers, a polyamide wrapping yarn disposed upon the tungsten core, and a high performance polyethylene wrapping yarn disposed upon the polyamide wrapping yarn, wherein the covered yarn is 350 denier or less. In some embodiments, the polymeric emulsion has a viscosity between 300-2000 centipoises during the dipping step. In some embodiments, the polymeric emulsion includes a total solids content of 35-45%.

In some embodiments, the methods of making manufacturing a thin coated supported glove are suitable for forming a thin coated supported glove, including: a thin knitted liner, including a plurality of finger components, a thumb component, a backhand component, and a palm component, wherein the thin knitted liner comprises a covered yarn comprising a tungsten core having a diameter of about 25-35 micrometers, a polyamide wrapping yarn disposed upon the tungsten core, and a high performance polyethylene wrapping yarn disposed upon the polyamide wrapping yarn, wherein the covered yarn is 350 denier or less; a second yarn, wherein the second yarn is an intermingled yarn of 115 denier or less; and a thin polymeric coating adhered to the thin knitted liner. In some embodiments, the thin coated supported glove comprises a thin knitted liner which is a 21-gauge liner. In embodiments, the glove has a thickness of approximately 0.8 mm and a level A5 cut resistance. In some embodiments, the glove has a thickness of approximately 0.9 mm and a level A5 cut resistance. In some embodiments, the glove has a thickness of approximately 1.1 mm and a level A7 cut resistance. In some embodiments, the tungsten core has a diameter of about 30 micrometers. In some embodiments, the polyamide wrapping yarn is textured. In some embodiments, a first covered yarn includes tungsten in an amount of about 40% weight of the total covered yarn, polyamide in an amount of about 44% weight of the total covered yarn, and high performance polyethylene in an amount of about 16% weight of the total covered yarn. In some embodiments, an intermingled yarn includes a polyamide yarn of 40 denier or less and a polyether-polyurea copolymer yarn of 70 denier or less. In some embodiments, the intermingled yarn or the polyamide wrapping yarn is a nylon 6 or nylon 6,6 yarn. In some embodiments, the thin polymeric coating includes a polymeric emulsion having a total solids content ranging from 35-45%. In some embodiments, the thin coated supported glove ranges from 0.8 to 1.00 mm in cross-sectional thickness in polymer coated regions. In some embodiments, the thin coated supported glove ranges from 0.8 to 1.20 mm in cross-sectional thickness in polymer coated regions. In some embodiments, the thin supported glove has an EN388 abrasion level of 4 or greater.

In one embodiment, a glove in accordance with the present disclosure has a total glove thickness of 0.8 mm to 0.9 mm in polymer coated regions, wherein the liner thereof has a thickness of 0.5 mm to 0.6 mm, wherein the glove is characterized as machine gauge seamless—21. In such an embodiment, the durability of the glove is characterized as having an EN abrasion level of 4. In such an embodiment the glove provides ANSI Standard level A5, level A6, or level A7 cut protection. In embodiments, the yarn denier for forming the glove is approximately 350 denier, or 350 denier.

In some embodiments, the thickness of the glove is varied to change the cut resistance. Non-limiting examples of suitable glove for use herein include gloves having a thickness and cut resistance as shown below in Table 2 (including cut resistances pursuant to International Standards Organization ISO 13997 (1999)).

TABLE 2

| THICKNESS OF LINER (MM) | THICKNESS OF GLOVE (MM) | GAUGE | CUT RESISTANCE |
|---|---|---|---|
| 0.51-0.55 | 0.83-0.88 | 21 | ANSI Cut A5/ISO Cut Level E |
| 0.62-0.66 | 1.00-1.05 | 18 | ANSI Cut A5 |
| 0.79-0.83 | 1.16-1.20 | 15 | ANSI Cut A7/ISI Cut Level F |

In some embodiments, gloves of the present disclosure include an inner yarn including: a tungsten filament, a nylon first wrapping yarn; and an outer high performance polyethylene (HPPE) wrapping yarn. The glove also includes a second yarn for use as an outer yarn including a mixture of spandex (70 Denier) and nylon (40 Denier). The first and second yarn are suitable for forming liners in accordance with the present disclosure.

In some embodiments, a thin coated supported glove, includes: a 21-gauge knitted liner, comprising a plurality of finger components, a thumb component, a backhand component, and a palm component, wherein the 21-gauge knitted liner comprises a covered yarn comprising a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn of 115 denier or less comprising a nylon and spandex; and a thin polymeric coating adhered to the 21-gauge knitted liner. In embodiments, the nylon is 30 to 50 denier. In embodiments, the spandex is 20 to 80 denier. In embodiments, the covered yarn is between 320 and 350 denier. In some embodiments, the second yarn is 105 to 115 denier.

In some embodiments, cut resistance refers to gloves or fabric that satisfies the cut test requirement set forth in the ANSI/ISEA 105 (2016) standard with cut resistance levels characterized as A1 to A9. In some embodiments, gloves or fabric thereof in accordance with the present disclosure satisfies the cut test requirement set forth in the ANSI/ISEA 105-2016 standard and are characterized as having cut resistance level A5 where the weight in grams for a cutting distance exceeding 20 mm is greater than or equal to 2200. In some embodiments, gloves or fabric thereof in accordance with the present disclosure satisfies the cut test requirement set forth in the ANSI/ISEA 105 (2016) standard and are characterized as having cut resistance level A6 where the weight in grams for a cutting distance exceeding 20 mm is greater than or equal to 3000. In some embodiments, gloves or fabric thereof in accordance with the present disclosure satisfies the cut test requirement set forth in the ANSI/ISEA 105 (2016) standard and are characterized as having cut resistance level A7.

In some embodiments, abrasion resistance refers to ability of a glove or fabric to resist surface wear caused by flat rubbing contact with another material. While there are a number of tests for measuring abrasion resistance known in the art, in embodiments, gloves or fabric in accordance with the present disclosure may be evaluated for abrasion resistance in accordance with the European standard used to evaluate mechanical risks for hand protection. In some embodiments gloves and glove fabric in accordance with the present disclosure satisfy the EN 388:2016 abrasion test requirements and have a protection level of 4 as set forth in accordance with this standard.

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the thin knitted liner is a 21-gauge liner.

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the glove in polymer coated regions has a thickness of approximately 0.7 mm to about 0.9 mm (e.g., about 0.75 mm to about 0.85 mm, or about 0.8 mm) and a level A5 cut resistance.

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the thin knitted liner has a thickness of approximately 0.4 mm to about 0.6 mm (e.g., about 0.45 mm to about 0.55 mm, or about 0.5 mm).

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the glove in polymer coated regions has a thickness of approximately 1.1 mm to about 1.2 mm and a level A7 cut resistance.

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the thin knitted liner has a thickness of approximately 0.7 to 0.8 mm.

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the glove in polymer coated regions has a thickness of about 0.9 mm to about 1.1 mm (e.g., about 0.95 to about 1.05 mm or approximately 1.00 mm) and a level A5 cut resistance, wherein the thickness of the thin knitted liner is about 0.5 mm to about 0.7 mm (e.g., about 0.55 mm to about 0.65 mm, or approximately 0.6 mm).

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the tungsten core has a diameter of about 28 to about 32 micrometers (e.g. about 29 mm to about 31 mm, or about 30 micrometers).

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is about 350 denier or less; a second yarn, wherein the second yarn comprises or consists of an intermingled yarn of about 115 denier or less; a thin polymeric coating adhered to the thin knitted liner, wherein the covered yarn comprises or consists of tungsten in an amount of about 38% to about 42% weight of the total covered yarn (e.g., about 39% to about 41%, or about 40%), polyamide in an amount of about 42% to about 44% weight of the total covered yarn (e.g., about 43% to about 45%, or about 44%), and high-performance polyethylene in an amount of about 14% to about 18% weight of the total covered yarn (e.g., about 15% to about 17%, or about 16%).

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the intermingled yarn comprises or consists of a polyamide yarn of 40 denier or less and a polyether-polyurea copolymer yarn of 70 denier or less.

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the intermingled yarn or the polyamide wrapping yarn comprises of consists of a nylon 6 or nylon 6,6 yarn.

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the thin polymeric coating comprises a polymeric emulsion having a total solids content ranging from 40-46%.

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the thin coated supported glove in polymer coated regions ranges from 0.8 to 1.20 mm in cross-sectional thickness.

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the thin supported glove has an EN388 abrasion level of 4 or greater.

In embodiments, the present disclosure includes a thin coated supported glove, including: a thin knitted liner, including a plurality of finger components, a thumb component, a backhand component, and a palm component, wherein the thin knitted liner comprises a covered yarn comprising or consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less; a second yarn, wherein the second yarn comprises or consists of an intermingled yarn of 115 denier or less; and a thin polymeric coating adhered to the thin knitted liner, wherein the tungsten core has a diameter of about 28 to about 32 micrometers (e.g., about 29 to about 31 micrometers, or about 30 micrometers), wherein the covered yarn comprises or consists of tungsten in an amount of about 38% to about 42% weight of the total covered yarn (e.g., about 39% to about 41%, or about 40%), polyamide in an amount of about 42% to about 46% weight of the total covered yarn (e.g., about 43% to about 45%, or about 44%), and high-performance polyethylene in an amount of about 14% to about 18% weight of the total covered yarn (e.g., about 15% to about 17%, or about 16%), wherein the intermingled yarn comprises or consists of a polyamide yarn of 40 denier or less and a polyether-polyurea copolymer yarn (such as a spandex) of 70 denier or less, wherein the intermingled yarn or the polyamide wrapping yarn is a nylon 6 or nylon 6,6 yarn, wherein the thin polymeric coating comprises a polymeric emulsion having a total solids content ranging from 40-46%, and wherein the thin coated supported glove in polymer coated regions ranges from 0.8 to 1.20 mm in cross-sectional thickness.

In some embodiments, the present disclosure includes a method for manufacturing a thin coated supported glove, including: dressing a knitted liner such as a 21-gauge knitted liner on a hand-shaped former; applying an aqueous coagulant solution to the 21-gauge knitted liner; dipping the 21-gauge knitted liner into a polymeric emulsion, wherein the polymeric emulsion is a 100 parts per hundred rubber (PHR) nitrile-butadiene polymer formulation, forming a polymeric coating on the knitted liner; and curing the polymeric coating to form a thin coated support glove, wherein the 21-gauge knitted liner comprises a plurality of finger components, a thumb component, a backhand component, and a palm component, wherein the 21-gauge knitted liner comprises a covered yarn comprising a tungsten core having a diameter of about 25-35 micrometers, a polyamide wrapping yarn disposed upon the tungsten core, and a high performance polyethylene wrapping yarn disposed upon the polyamide wrapping yarn, wherein the covered yarn is 350 denier or less, wherein the polymeric emulsion has a viscosity between 300-2000 centipoises during the dipping step, and, wherein the polymeric emulsion comprises or consists of a total solids content of 35-45%.

All ranges recited herein include ranges therebetween, and can be inclusive or exclusive of the endpoints. Optional included ranges are from integer values therebetween (or inclusive of one original endpoint), at the order of magnitude recited or the next smaller order of magnitude. For example, if the lower range value is 0.2, optional included endpoints can be 0.3, 0.4, . . . 1.1, 1.2, and the like, as well as 1, 2, 3 and the like; if the higher range is 8, optional included endpoints can be 7, 6, and the like, as well as 7.9, 7.8, and the like. One-sided boundaries, such as 3 or more, similarly include consistent boundaries (or ranges) starting at integer values at the recited order of magnitude or one lower. For example, 3 or more includes 4 or more, or 3.1 or more. If there are two ranges mentioned, such as about 1 to 10 and about 2 to 5, those of skill will recognize that the implied ranges of 1 to 5 and 2 to 10 are within the invention.

A laminate is a bonding, fusing, adhesion, or the like between polymer layers, or between polymer and fabric layers, such that in the range of anticipated use the laminate is a unitary structure.

Where a sentence states that its subject is found in embodiments, or in certain embodiments, or in the like, it is applicable to any embodiment in which the subject matter can be logically applied.

This invention described herein is of thin coated supported gloves and methods of forming or using the same. Although some embodiments have been discussed above, other implementations and applications are also within the scope of the following claims. Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims. More specifically, those of skill will recognize that any embodiment described herein that those of skill would recognize could advantageously have a sub-feature of another embodiment, is described as having that sub-feature.

Numbered Embodiments

The invention can be described further in the following numbered embodiments:

Embodiment 1: A thin coated supported glove, comprising: (I) a thin knitted liner, comprising a plurality of finger components, a thumb component, a backhand component, and a palm component, wherein the thin knitted liner comprises (a) a covered yarn comprising a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is about 350 denier or less, and (b) a second yarn, wherein the second yarn is an intermingled yarn of 115 denier or less, the liner having a thickness of about 0.4 mm to about 0.8 mm; and (II) a thin polymeric coating adhered to the thin knitted liner such that coated regions of the liner have a thickness from about 0.7 mm to about 1.2 mm.

Embodiment 2: A thin coated supported glove, comprising: (I) a 21 to 28-gauge knitted liner, comprising a plurality of finger components, a thumb component, a backhand component, and a palm component, wherein the knitted liner comprises (a) a covered yarn comprising a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less and (b) a second yarn of 115 denier or less comprising a nylon and spandex; and (II) a thin polymeric coating adhered to the 21-gauge knitted liner Embodiment 3: A method for manufacturing a thin coated supported glove, comprising: (a) dressing a 21 to 28-gauge knitted liner on a hand-shaped former; (b) applying an aqueous coagulant solution to the knitted liner; (c) dipping the knitted liner into a polymeric emulsion, wherein the polymeric emulsion is a about 60 to about 100 PHR nitrile-butadiene polymer formulation, forming a polymeric coating on the knitted liner; and (d) curing the polymeric coating to form a thin coated support glove, wherein the knitted liner comprises a plurality of finger components, a thumb component, a backhand component, and a palm component, wherein the knitted liner comprises a covered yarn comprising a tungsten core having a diameter of about 25 to about 35 micrometers, a polyamide wrapping yarn disposed upon the tungsten core, and a high performance polyethylene wrapping yarn disposed upon the polyamide wrapping yarn, wherein the covered yarn is about 350 denier or less.

Embodiment 4: The thin coated supported glove or method of making a thin coated supported glove of a numbered embodiment, wherein the thin knitted liner is a 21 to 23-gauge liner.

Embodiment 5: The thin coated supported glove or method of making a thin coated supported glove of a numbered embodiment, wherein the thin knitted liner is a 21-gauge liner.

Embodiment 6: The thin coated supported glove or method of making a thin coated supported glove of a numbered embodiment, wherein the liner is single knit.

Embodiment 7: The thin coated supported glove or method of making a thin coated supported glove of a numbered embodiment, wherein the liner is single Jersey knit.

Embodiment 8: The thin coated supported glove or method of making a thin coated supported glove of a numbered embodiment, wherein the glove has a thickness of about 0.7 mm to about 0.9 mm and a level A5 cut resistance.

Embodiment 9: The thin coated supported glove or method of making a thin coated supported glove of a numbered embodiment of claim 3, wherein the thin knitted liner has a thickness of about 0.4 mm to about 0.6 mm.

Embodiment 10: The thin coated supported glove or method of making a thin coated supported glove of a numbered embodiment, wherein the glove has a thickness of approximately 1.1 mm to about 1.2 mm and a level A7 cut resistance.

Embodiment 11: The thin coated supported glove or method of making a thin coated supported glove of a numbered embodiment of claim 5, wherein the thin knitted liner has a thickness of approximately 0.7 to about 0.8 mm.

Embodiment 12: The thin coated supported glove or method of making a thin coated supported glove of a numbered embodiment, wherein the glove has a thickness of approximately 0.9 mm to about 1.1 mm and a level A5 cut resistance, wherein the thickness of the thin knitted liner is approximately 0.5 mm to about 0.7 mm.

Embodiment 13: The thin coated supported glove or method of making a thin coated supported glove of a numbered embodiment, wherein the tungsten core has a diameter of about 28 to about 32 micrometers.

Embodiment 14: The thin coated supported glove or method of making a thin coated supported glove of a numbered embodiment, wherein the covered yarn comprises tungsten in an amount of about 32 to about 42% weight of the total covered yarn, polyamide in an amount of about 42 to about 46% weight of the total covered yarn, and high-performance polyethylene in an amount of about 14 to about 18% weight of the total covered yarn.

Embodiment 15: The thin coated supported glove or method of making a thin coated supported glove of a numbered embodiment, wherein the intermingled yarn comprises a polyamide yarn of about 40 denier or less and a polyether-polyurea copolymer yarn of about 70 denier or less.

Embodiment 16: The thin coated supported glove or method of making a thin coated supported glove of a numbered embodiment, wherein the intermingled yarn or the polyamide wrapping yarn is a nylon 6 or nylon 6,6 yarn.

Embodiment 17: The thin coated supported glove or method of making a thin coated supported glove of a numbered embodiment, wherein the thin polymeric coating comprises a coating formed with a polymeric emulsion having a total solids content ranging from 40-46%.

Embodiment 18: The thin coated supported glove or method of making a thin coated supported glove of a numbered embodiment, wherein the thin coated supported glove ranges from about 0.8 to about 1.20 mm in cross-sectional thickness.

Embodiment 19: The thin coated supported glove or method of making a thin coated supported glove of a numbered embodiment, wherein the thin supported glove has an EN388 abrasion level of 4 or greater.

Embodiment 20: The thin coated supported glove or method of making a thin coated supported glove of a numbered embodiment, wherein the nylon is about 30 to about 50 denier.

Embodiment 21: The thin coated supported glove or method of making a thin coated supported glove of a numbered embodiment, wherein the spandex is 20 to 80 denier, and, wherein the covered yarn is between about 330 and about 350 denier.

Embodiment 22: The method of method of making a thin coated supported glove of a numbered embodiment, wherein the polymeric emulsion has a viscosity between about 300 and about 2000 centipoises during the dipping step.

Embodiment 23: The method of method of making a thin coated supported glove of a numbered embodiment, wherein the polymeric emulsion comprises a total solids content of 35-46%.

Publications and references, including but not limited to patents and patent applications, cited in this specification are herein incorporated by reference in their entirety in the entire portion cited as if each individual publication or reference were specifically and individually indicated to be incorporated by reference herein as being fully set forth. Any patent application to which this application claims priority is also incorporated by reference herein in the manner described above for publications and references.

What is claimed is:

1. A thin coated supported glove, comprising:

a thin knitted liner, comprising a plurality of finger components, a thumb component, a backhand component, and a palm component, wherein the thin knitted liner comprises (a) a covered yarn consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is about 350 denier or less, and (b) a second yarn, wherein the second yarn is an intermingled yarn of 115 denier or less, the liner having a thickness of about 0.4 mm to about 0.8 mm; and a thin polymeric coating adhered to the thin knitted liner such that coated regions of the liner have a thickness from about 0.7 mm to about 1.2 mm.

2. The thin coated supported glove of claim 1, wherein the tungsten core has a diameter of about 28 to about 32 micrometers.

3. The thin coated supported glove of claim 1, wherein the thin supported glove has an EN388 abrasion level of 4 or greater.

4. The thin coated supported glove of claim 1, wherein the glove has a thickness of about 0.7 mm to about 0.9 mm and a level A5 cut resistance, and wherein the thin knitted liner has a thickness of about 0.4 mm to about 0.6 mm.

5. The thin coated supported glove of claim 1, wherein the glove has a thickness of approximately 1.1 mm to about 1.2 mm and a level A7 cut resistance, and wherein the thin knitted liner has a thickness of approximately 0.7 to about 0.8 mm.

6. The thin coated supported glove of claim 1, wherein the glove has a thickness of approximately 0.9 mm to about 1.1 mm and a level A5 cut resistance, and wherein the thickness of the thin knitted liner is approximately 0.5 mm to about 0.7 mm.

7. The thin coated supported glove of claim 1, wherein the covered yarn comprises tungsten in an amount of about 32 to about 42% weight of the total covered yarn, polyamide in an amount of about 42 to about 46% weight of the total covered yarn, and high-performance polyethylene in an amount of about 14 to about 18% weight of the total covered yarn.

8. The thin coated supported glove of claim 1, wherein the intermingled yarn comprises a polyamide yarn of about 40 denier or less and a polyether-polyurea copolymer yarn of about 70 denier or less.

9. A thin coated supported glove, comprising:

a 21 to 28-gauge knitted liner, comprising a plurality of finger components, a thumb component, a backhand component, and a palm component, wherein the knitted liner comprises (a) a covered yarn consisting of a tungsten core having a diameter of about 25-35 micrometers, a polyamide wrapping yarn disposed upon the tungsten core, and a high-performance polyethylene wrapping yarn disposed upon the polyamide wrapping yarn, wherein the covered yarn is 350 denier or less and (b) a second yarn of 115 denier or less comprising a nylon and spandex, optionally wherein the nylon is about 30 to about 50 denier, optionally wherein the spandex is 20 to 80 denier; and a thin polymeric coating adhered to the knitted liner.

10. The thin coated supported glove of claim 9, wherein the tungsten core has a diameter of about 28 to about 32 micrometers.

11. The thin coated supported glove of claim 9, wherein the thin supported glove has an EN388 abrasion level of 4 or greater.

12. The thin coated supported glove of claim 9, wherein the glove has a thickness of about 0.7 mm to about 0.9 mm and a level A5 cut resistance, and wherein the thin knitted liner has a thickness of about 0.4 mm to about 0.6 mm.

13. The thin coated supported glove of claim 9, wherein the glove has a thickness of approximately 1.1 mm to about 1.2 mm and a level A7 cut resistance, and wherein the thin knitted liner has a thickness of approximately 0.7 to about 0.8 mm.

14. The thin coated supported glove of claim 9, wherein the glove has a thickness of approximately 0.9 mm to about 1.1 mm and a level A5 cut resistance, and wherein the thickness of the thin knitted liner is approximately 0.5 mm to about 0.7 mm.

15. The thin coated supported glove of claim 9, wherein the covered yarn comprises tungsten in an amount of about 32 to about 42% weight of the total covered yarn, polyamide in an amount of about 42 to about 46% weight of the total covered yarn, and high-performance polyethylene in an amount of about 14 to about 18% weight of the total covered yarn.

16. A method for manufacturing a thin coated supported glove, comprising:

dressing a 21 to 28-gauge knitted liner on a hand-shaped former;

applying an aqueous coagulant solution to the knitted liner;

dipping the knitted liner into a polymeric emulsion, wherein the polymeric emulsion is a about 60 to about 100 PHR nitrile-butadiene polymer formulation, forming a polymeric coating on the knitted liner; and curing the polymeric coating to form a thin coated support glove, wherein the knitted liner comprises the thin knitted liner of claim 1.

17. The method of claim 16, wherein the liner is 21 to 23-gauge.

18. The method of claim 16, wherein the liner is single knit.

19. The method of claim 16, wherein the polymeric emulsion has a viscosity between about 300 and about 2000 centipoises during the dipping step.

20. The method of claim 16, wherein the polymeric emulsion comprises a total solids content of 35-46%.

* * * * *